US008851315B2

(12) United States Patent
Vovan

(10) Patent No.: US 8,851,315 B2
(45) Date of Patent: Oct. 7, 2014

(54) VERSATILE TAMPER-EVIDENT FOOD CONTAINER

(75) Inventor: Terry Vovan, Rialto, CA (US)

(73) Assignee: Pactiv Packaging Inc., Lake Forest, IL (US)

( * ) Notice: Subject to any disclaimer, the term of this patent is extended or adjusted under 35 U.S.C. 154(b) by 0 days.

(21) Appl. No.: 13/301,214

(22) Filed: Nov. 21, 2011

(65) Prior Publication Data

US 2012/0061412 A1 Mar. 15, 2012

Related U.S. Application Data

(63) Continuation of application No. 11/230,978, filed on Sep. 20, 2005, now Pat. No. 8,083,089.

(60) Provisional application No. 60/698,736, filed on Jul. 13, 2005.

(51) Int. Cl.

| | |
|---|---|
| ***B65D 17/28*** | (2006.01) |
| ***B65D 17/40*** | (2006.01) |
| ***B65D 43/16*** | (2006.01) |
| *B65D 17/34* | (2006.01) |

(52) U.S. Cl.

CPC ..... *B65D 43/162* (2013.01); *B65D 2101/0023* (2013.01)

USPC ..... 220/359.2; 220/4.23; 220/270; 220/276; 220/359.4; 220/793

(58) Field of Classification Search

USPC ..... 220/4.23, 4.22, 266, 270, 276, 359.2

See application file for complete search history.

(56) References Cited

U.S. PATENT DOCUMENTS

| | | | |
|---|---|---|---|
| 3,495,759 | A | 2/1970 | Bergstrom et al. |
| 3,572,579 | A | 3/1971 | Mueller et al. |
| 3,773,207 | A | 11/1973 | Dokoupil et al. |
| 3,836,039 | A | 9/1974 | Seiferth et al. |
| 3,860,148 | A | 1/1975 | Sherin |

(Continued)

FOREIGN PATENT DOCUMENTS

| | | |
|---|---|---|
| DE | 7816353 | 11/1978 |
| DE | 4418935 | 12/1995 |

(Continued)

OTHER PUBLICATIONS

U.S. Appl. No. 12/200,670, filed Aug. 28, 2008, Vovan.

(Continued)

*Primary Examiner* — Mickey Yu
*Assistant Examiner* — Niki Eloshway
(74) *Attorney, Agent, or Firm* — Baker Botts LLP

(57) ABSTRACT

A tamper-evident rigid plastic food container system wherein the outer periphery of the mating surfaces of the lid and tray are permanently bonded together after the food product has been placed in the tray, a set of perforated rows at an inner periphery, the interconnect of which needs to be torn in order to open the lid. Intentional, inadvertent, or malicious ingress into the container can only be made by tearing at the perforations and thereby evidencing the potential tampering and contamination of the packaging contents. The lid and tray edges may further include mechanical interference fits, including snap-fit grips that may be of the releasably lockable kind to permit sealing, release, and re-sealing multiple times without deterioration in reliability, and which can further prevent or minimize leakage of liquid food product.

19 Claims, 12 Drawing Sheets

(56) References Cited

U.S. PATENT DOCUMENTS 3,870,219 A 3/1975 Reisman
3,941,248 A 3/1976 Moser et al.
4,006,839 A 2/1977 Thiel et al.
4,091,930 A 5/1978 Buchner et al.
4,113,136 A 9/1978 Abbott
4,150,748 A 4/1979 Mueller
4,262,814 A 4/1981 Roccaforte
4,332,332 A 6/1982 Ingemann
4,433,793 A 2/1984 Ingemann
4,453,666 A 6/1984 Gordon
4,520,943 A 6/1985 Nielsen
4,535,889 A 8/1985 Terauds
4,541,541 A 9/1985 Hickman et al.
4,560,082 A 12/1985 Sutch
4,610,371 A 9/1986 Karkiewicz
4,671,453 A 6/1987 Cassidy
4,678,083 A 7/1987 Anderson
4,721,210 A 1/1988 Lawrence et al.
4,742,935 A 5/1988 Schellenberg
4,747,510 A 5/1988 Mack
4,757,898 A 7/1988 Klein
4,759,463 A 7/1988 Mazoin
4,765,463 A 8/1988 Chanel
4,785,963 A 11/1988 Magley
4,792,054 A 12/1988 Weidman
4,819,824 A 4/1989 Longbottom et al.
4,854,472 A 8/1989 Semersky
4,874,096 A 10/1989 Tessera-Chiesa
4,878,595 A 11/1989 Uhlig
4,881,656 A 11/1989 Chumley et al.
4,890,758 A 1/1990 Gailus
4,930,656 A 6/1990 Blanchette
4,966,292 A 10/1990 Marino
4,966,294 A 10/1990 Mack et al.
4,974,735 A 12/1990 Newell et al.
4,998,622 A 3/1991 Drack
5,002,198 A 3/1991 Smith
5,007,231 A 4/1991 Ingemann
5,027,969 A 7/1991 Lesquir
5,040,695 A 8/1991 Adams et al.
5,052,572 A 10/1991 Pherigo
5,052,574 A 10/1991 McKinnon et al.
5,111,953 A 5/1992 Faust et al.
5,111,954 A 5/1992 Gaudreault
5,114,068 A * 5/1992 Reil et al. ..... 229/123.2
5,115,934 A 5/1992 Nelson
5,129,531 A 7/1992 Beck et al.
5,163,575 A 11/1992 Luch et al.
5,170,905 A 12/1992 Luch
5,219,074 A 6/1993 Mizuno et al.
5,219,087 A 6/1993 Christensson
5,249,694 A 10/1993 Nelson
5,283,940 A 2/1994 Luch et al.
5,287,959 A 2/1994 Hansen et al.
5,307,948 A 5/1994 Blackburn et al.
5,377,860 A 1/1995 Littlejohn et al.
5,405,629 A 4/1995 Marnocha et al.
5,421,473 A 6/1995 McCrossen
5,437,386 A 8/1995 Von Holdt
5,507,405 A 4/1996 Thomas et al.
5,507,406 A 4/1996 Urciuoli et al.
5,511,679 A 4/1996 Beck
5,511,680 A 4/1996 Kinne
5,528,814 A 6/1996 Luch et al.
5,545,375 A 8/1996 Tropsha et al.
5,573,134 A 11/1996 Chenault et al.
5,582,853 A 12/1996 Marnocha et al.
5,603,422 A 2/1997 Herrmann
5,607,075 A 3/1997 Burgdorf et al.
5,626,251 A 5/1997 Luburic et al.
5,683,771 A 11/1997 Tropsha
5,842,593 A 12/1998 von Holdt
5,875,913 A 3/1999 Letica
5,897,011 A 4/1999 Brilliant et al.
5,931,291 A 8/1999 Sedon et al.
5,931,332 A 8/1999 Mygatt et al.
5,979,690 A 11/1999 Hartley
6,000,570 A 12/1999 Nelson
6,056,141 A 5/2000 Navarini et al.
RE36,729 E 6/2000 Luch et al.
6,116,501 A 9/2000 Hupp
6,135,304 A 10/2000 Wyslotsky
6,168,044 B1 1/2001 Zettle et al.
6,193,921 B1 2/2001 Nelson
6,257,435 B1 7/2001 Chedister et al.
6,273,291 B1 8/2001 Conti
6,276,529 B1 8/2001 Feehan, Jr.
6,279,774 B1 8/2001 Clute et al.
6,299,012 B1 10/2001 Redmond
6,328,355 B1 12/2001 Bortz
6,349,828 B1 2/2002 Sessions et al.
6,564,958 B1 5/2003 Ramsey et al.
6,572,909 B1 6/2003 Bagwell et al.
6,604,645 B1 8/2003 Vaupotic
6,712,233 B2 3/2004 Arshinoff
6,772,901 B2 8/2004 Witt
6,779,676 B2 8/2004 Ciccone
6,845,878 B2 1/2005 Hayes et al.
6,899,245 B1 5/2005 Nelson
6,926,165 B2 8/2005 Conti
7,004,341 B2 2/2006 Shenkar et al.
7,011,221 B2 3/2006 Smith et al.
7,011,228 B2 3/2006 Ordiway
7,021,826 B2 4/2006 Benjamins
7,073,680 B2 7/2006 Boback et al.
7,097,058 B2 8/2006 Wellman et al.
7,114,619 B2 10/2006 Ellis et al.
7,118,003 B2 10/2006 Sellari et al.
7,134,567 B2 11/2006 Luburic
7,191,931 B2 3/2007 Damkjaer
7,207,457 B2 4/2007 Schwarz
7,222,741 B2 5/2007 Chmela et al.
7,235,207 B2 6/2007 Gregory et al.
7,243,813 B2 7/2007 Krueger
7,246,714 B2 7/2007 Garg et al.
7,281,638 B2 10/2007 Hierzer et al.
7,303,088 B2 12/2007 Sawyer et al.
7,311,218 B2 12/2007 Varadarajan
7,338,209 B2 3/2008 Winpenny
7,357,272 B2 4/2008 Maxwell
7,374,053 B2 5/2008 Herald et al.
7,475,780 B2 1/2009 Hinze et al.
7,475,788 B2 1/2009 Schwarz
7,549,540 B2 6/2009 Lee et al.
7,611,025 B2 11/2009 Nusbaum et al.
7,631,776 B2 12/2009 Vovan et al.
7,757,848 B2 7/2010 Gelardi et al.
8,028,851 B2 10/2011 Vovan et al.
8,083,089 B2 12/2011 Vovan
2003/0183636 A1 10/2003 Shih
2004/0045867 A1 3/2004 Appelbaum
2004/0118848 A1 6/2004 Marshall
2004/0134910 A1 7/2004 Colombo
2005/0252916 A1 11/2005 Varadarajan
2006/0003879 A1 1/2006 Buchman
2006/0006178 A1 1/2006 Foldesi et al.
2006/0011632 A1 1/2006 Caille
2006/0060578 A1 3/2006 Church et al.
2006/0144874 A1 7/2006 Solowiejko
2006/0163265 A1 7/2006 De Candido
2006/0175334 A1 8/2006 Schwarz
2006/0201946 A1 9/2006 Witt
2006/0249474 A1 11/2006 Sawyer et al.
2006/0255054 A1 11/2006 Vovan
2006/0261070 A1 11/2006 Robertson et al.
2006/0266750 A1 11/2006 Lesquir
2006/0278652 A1 12/2006 Vovan et al.
2006/0289549 A1 12/2006 Vovan
2007/0012710 A1 1/2007 Vovan
2007/0045317 A1 3/2007 Rosender et al.
2007/0062903 A1 3/2007 Norman et al.
2007/0062948 A1 3/2007 Albrecht et al.
2007/0095848 A1 5/2007 Galland et al.
2007/0108210 A1 5/2007 Alvares et al.

(56) References Cited

U.S. PATENT DOCUMENTS

| | | | |
|---|---|---|---|
| 2007/0138046 | A1 | 6/2007 | Vovan |
| 2007/0138180 | A1 | 6/2007 | Vovan |
| 2007/0164026 | A1 | 7/2007 | Morrissey et al. |
| 2007/0196541 | A1 | 8/2007 | Vovan et al. |
| 2008/0000904 | A1 | 1/2008 | Vovan |
| 2008/0006632 | A1 | 1/2008 | Vovan |
| 2008/0110887 | A1 | 5/2008 | Ramsey et al. |
| 2008/0185383 | A1 | 8/2008 | Philippe et al. |
| 2008/0199108 | A1 | 8/2008 | Rogers |
| 2009/0021026 | A1 | 1/2009 | Collier |
| 2009/0032534 | A1 | 2/2009 | Luburic |
| 2009/0032545 | A1 | 2/2009 | Zeiler et al. |
| 2009/0057313 | A1 | 3/2009 | Alvares |
| 2009/0120936 | A1 | 5/2009 | Zauser et al. |
| 2009/0120942 | A1 | 5/2009 | Vovan |
| 2009/0206082 | A1 | 8/2009 | Vovan |
| 2010/0065567 | A1 | 3/2010 | Vovan |
| 2010/0072205 | A1 | 3/2010 | Stuart |
| 2010/0072217 | A1 | 3/2010 | Parikh et al. |
| 2010/0155289 | A1 | 6/2010 | Nazareth et al. |

FOREIGN PATENT DOCUMENTS

| | | |
|---|---|---|
| DE | 29819718 | 1/1999 |
| DE | 29914659 | 8/1999 |
| EP | 0752374 | 1/1997 |
| EP | 1559656 | 8/2005 |
| FR | 2819496 | 1/2001 |
| GB | 2257118 | 1/1993 |
| WO | WO 2005/082733 | 9/2005 |
| WO | WO 2005/082734 | 9/2005 |

OTHER PUBLICATIONS

U.S. Appl. No. 12/371,888, filed Feb. 16, 2009, Vovan.
U.S. Appl. No. 11/466,622, Oct. 30, 2009 Issue Fee payment.
U.S. Appl. No. 11/446,622, Oct. 19, 2009 Notice of Allowance.
U.S. Appl. No. 11/446,622, Sep. 15, 2009 Response to Final Office Action.
U.S. Appl. No. 11/446,622, Jun. 24, 2009 Final Office Action.
U.S. Appl. No. 11/446,622, Jun. 5, 2009 Supplemental Amendment.
U.S. Appl. No. 11/446,622, Mar. 26, 2009 Response to Non-Final Office Action.
U.S. Appl. No. 11/446,622, Jan. 26, 2009 Non-Final Office Action.
U.S. Appl. No. 12/626,476, Dec. 1, 2011 Non-Final Office Action.
U.S. Appl. No. 11/230,978, Nov. 21, 2011 Issue Fee payment.
U.S. Appl. No. 11/230,978, Aug. 22, 2011 Notice of Allowance.
U.S. Appl. No. 11/230,978, Jun. 21, 2011 Response to Non-Final Office Action.
U.S. Appl. No. 11/230,978, Apr. 15, 2011 Non-Final Office Action.
U.S. Appl. No. 11/230,978, Dec. 28, 2010 Response to Non-Final Office Action.
U.S. Appl. No. 11/230,978, Sep. 16, 2010 Non-Final Office Action.
U.S. Appl. No. 11/230,978, Aug. 27, 2010 Amendment and Request for Continued Examination (RCE).
U.S. Appl. No. 11/230,978, May 27, 2010 Final Office Action.
U.S. Appl. No. 11/230,978, Feb. 9, 2010 Response to Non-Final Office Action.
U.S. Appl. No. 11/230,978, Sep. 10, 2009 Non-Final Office Action.
U.S. Appl. No. 11/230,978, Aug. 13, 2009 Amendment and Request for Continued Examination (RCE).
U.S. Appl. No. 11/230,978, May 14, 2009 Final Office Action.
U.S. Appl. No. 11/230,978, Jan. 26, 2009 Supplemental Amendment.
U.S. Appl. No. 11/230,978, Sep. 15, 2008 Response to Non-Final Office Action.
U.S. Appl. No. 11/230,978, Jun. 2, 2008 Non-Final Office Action.
U.S. Appl. No. 12/589,050, Aug. 26, 2011 Issue Fee payment.
U.S. Appl. No. 12/589,050, May 31, 2011 Notice of Allowance.
U.S. Appl. No. 12/589,050, Mar. 9, 2011 Response to Non-Final Office Action.
U.S. Appl. No. 12/589,050, Dec. 9, 2010 Non-Final Office Action.
Food container purportedly published in Apr. 2005.
Safer sandwiches, www.packagingtoday.co.uk—Packaging Today, purportedly published in Apr. 2005.
Tamper Evident Container, dated Sep. 13, 2004 and purportedly exhibited in a foreign country in Apr. 2005.
Tri-Star to Unveil First ever Tamper Evident Sald Containers at Total Sandwich Show, sandwich and Snack news, purportedly published in Apr. 2005.
U.S. Appl. No. 12/626,476, Mar. 1, 2012 Response to Non-Final Office Action.
U.S. Appl. No. 12/626,476, Apr. 27, 2012 Notice of Allowance.

* cited by examiner

VERSATILE TAMPER-EVIDENT FOOD CONTAINER

CROSS-REFERENCE TO RELATED APPLICATIONS

This application is a continuation of U.S. patent application Ser. No. 11/230,978, filed on Sep. 20, 2005, which claims priority under 35 U.S.C. Section 119(e) and 37 C.F.R. Section 1.78 to U.S. Provisional Application Ser. No. 60/698,736 entitled "Versatile Tamper-Evident Food Container" by Terry Vovan, filed on Jul. 13, 2005. The aforementioned priority and related applications, which are commonly assigned, are hereby incorporated by reference herein in their entireties for all purposes.

FIELD OF THE INVENTION

The present invention relates to rigid food packaging containment that preserves and facilitates the displaying of contents. More particularly, the invention relates to a food packaging containment system that visually evidences unauthorized ingress if interfered either inadvertently or with the intent to cause harm.

BACKGROUND

Retail markets have utilized rigid and flexible plastic containers to contain and display perishable and fragile food items both hot and cold, such as sandwiches, salads and bakery items. These traditional roles of plastic packaging are now the minimum expected standards, and the 20 requirements placed on plastic food packaging continue to expand as increasing demands are placed upon it. Presentation, brand presence, consumer desires, added value to enhance commercial competitiveness, differentiation, imagery and psychology has resulted in the design and application of plastic packaging becoming more challenging. Convenience continues to shape the future of packaging, with consumers gravitating toward packaged convenience items that minimize the impact on their behavior forcing packaging manufacturers to include social and environmental considerations into their development process.

Rigid plastic food containers are typically manufactured from Polystyrene, Polypropylene, Polyethylene Terephthalate (PET), Polyactide, Polyvinyl Chloride (PVC), or other rigid polymers. They generally comprise either of two-parts—a tray and lid—or they may be a one-piece construction with a hinge that modifies one portion of the container to act as the tray and the other connected portion to act as a lid. This general configuration of food containers in a large variety of shapes and cross-sections (circular, rectangular, square, and elliptical, etc.) has been available in the marketplace for many years.

However, a limitation or concern has been undisclosed potentially malicious ingress into such containers that can lead to inadvertent or intentional contamination of the contents of the food container. This has created an increased awareness of and demand for tamper-resistant and tamper-evident food packaging systems. Product tampering has been in existence for as long as there have been packaged consumer goods. The causes of tampering are varied but generally take one of two forms: the first is malevolent tampering, and the second is for personal gratification, where one samples a product and puts it back on the shelf and the next customer is unaware of the contamination. Both modes of tampering compromises the safety and quality of food package contents.

The costs of tampering are enormous. In addition to the recalling of tampered, as well as un-tampered product, the resulting negative publicity can lead to reduction in revenue and brand equity, with retailers being forced to stop purchasing from one or more products form the affected company or even litigation.

In 1982, Johnson and Johnson (J&J) experienced such a situation when numerous bottles of its Extra-Strength Tylenol capsules had been laced with cyanide. By the end of the crisis, J&J had spent $100 million recalling 31 million bottles, they ceased production of the product and further pursued redesign of its bottles. Seven people died from the ingestion of the cyanide-laced pills. The threat of tampering has been amplified in the wake of the terrorist attack of Sep. 11, 2001. Possible contamination of food product on a potentially larger scale been envisioned.

In the packaging industry, tampering is the interference with the package contents, and the risk of tampering is a phenomenon that we have come to accept as a necessary evil when making purchases. Today, it is impossible to find food packaging that does not have a security feature. Virtually every packaged food product is enclosed or is attached to a tamper-evident or tamper-proof security feature. Tamper-evident means that a package that has undergone tampering will show some readily observable sign that the tampering has taken place; the sign may be audible or visible. It is the opinion of the inventor that in addition to its functions of protecting the product inside against physical and microbiological harm and oxygen ingress, and of providing brand recognition and product differentiation in the marketplace, packaging should also be designed to protect the consumer against tampering, whether deliberate or accidental.

Methods developed and currently used to combat tampering have included bonding the edges of existing packages. The advantage of such an approach is that a barrier against tampering could be achieved without changing the packaging design. Alternatively, addition of clear or printed shrink-wrap over the neck edge joint between the lid and tray or the entire package that keeps the packaging and its contents secure have been used. These methods provide some assurance to the consumer that the product has not been interfered with. Similarly, other attempts developed to combat packaging product tampering include of under-lid barriers (e.g. heat-sealed pop-up lids, glued boxes and tape seals).

A limitation associated with these methods, however, is that they achieve only a low level of tamper-evident packaging. They are either not sufficiently or distinctively visible to the consumer, or they can be return to its original condition with a glue gun and a hair dryer. This further makes disposal of unused sealing material a security issue as unused, intact seals may be used to reseal contaminated product.

It would be advantageous to consumers if there were a simple method that would rapidly indicate if a rigid plastic food package had been interfered with, that is, opened and then re-closed prior to purchase.

As it is extremely difficult to develop product packaging that is regarded as fully tamper-proof, the packaging industry's efforts have been directed to develop solutions that would ensure that any tampering can be clearly visible to the potential consumer. In response to the evolving demands of consumers, retailers continue to seek novel plastic packaging solutions to improve on the safety, convenience and therefore marketability of food product.

As such, the inventors recognizes that greater utility of such rigid plastic containers would be obtained through improved tamper-evident containerization methods and designs to increase the safety to the consumer but yet retains both the functional aspects required from rigid plastic packaging. The present invention fulfills this need.

SUMMARY

The present invention relates to tamper-evident solutions for rigid plastic food containers. In one embodiment, the mating surfaces of the lid and tray of the food container systems is sealed using radiation curing of light-sensitive adhesives, as well as one or more of pre-existing mechanical interference fit sealing methods. Tamper-evidence of rigid plastic packaging is achieved by irreversibly bonding the mating surfaces of the lid and tray of the container system and the use of perforated rows adjacent to the periphery of the lid. Once sealed, the tray and the lid cannot be separated without tearing the material. In order to ingress the sealed container, the consumer will need to tear the lid along the perforated rows. It is not possible for undisclosed ingress to occur since such tampering would be clearly visible without visual aid. An improved tamper-evident product packaging as compared with existing rigid plastic containerization systems results.

In another embodiment, additional mechanical interference retaining mechanisms that further mate the lid and tray is added. One or more may be commonly used but highly effective snap-fit grip mechanisms.

The bonding of the lid to the tray of the container system is an important element of this invention. Once bonded at the mating surfaces of the lid/tray interface, the two parts cannot be separated without damaging the container. In one embodiment, the method of bonding of the lid and tray mating surfaces is selected from the group consisting of radiation light curing of adhesives including ultraviolet (UV) light and infrared (IR) light, ultrasonic (US) welding, radio frequency (RF) welding, and any combination thereof. In one embodiment, UV light is used to initiate the curing of photo-initiators and/or photosensitizes in the adhesive. The photo-initiators that, when exposed to UV light create polymer chains that change the material from a liquid to a solid. In another embodiment, IR light-sensitive adhesives are used for the curing process. As with UV light curing, the benefits of using IR are low space requirements and costs, rapid heating rate, as well as focused lighting to dry/cure only selected areas. There is a uniform drying of adhesive, without the risk of blisters. In one embodiment, UV or IR light-sensitive adhesive is pre-applied to the mating surfaces to be bonded of the lid and/or tray prior to shipping the food containers to the food processors. This is possible since UV or IR light-sensitive adhesives will not cure for a substantial period of time without exposure to light. At the food processor facility, the final food product can be placed into the tray prior to closing and then conveyed into the light chamber for sealing.

In another embodiment, a lifting tab that is a part of the lid is located at one end of the lid of the food container and facilitates the tearing of the lid at the perforations. The lifting tab may optionally include a discrete snap-fit grip to allow the lid to be further releaseably lockable to the tray. The invention can include various types of opening tabs or tamper-evident seals either at the corner or on any side of polygonal container.

In another embodiment, a continuous interlocking snap-fit grip retaining mechanism along the periphery of the lid and tray provides the consumer the ability to close and re-opening the package, and further provide a leak resistant groove to accommodate semi-liquid products (i.e. fruits juices, sauces).

One advantage of using radiation light curing is that the floor space needed to accommodate the requisite equipment is low, the power requirements are low and production speed may be enhanced through automation.

In one embodiment, bonding of the lid to the tray is achieved using RF welding. Sometimes referred to as Dielectric welding or High Frequency welding, RF welding may be used to fuse the lid and tray together by applying radio frequency energy to the area to be bonded. Only certain materials can be RF welded as it relies on certain properties of the material, e.g. thermoplastics, to cause the generation of heat in the alternating electromagnetic field. Normally applied between two metal bars, these bars may also act as pressure applicators over the lid and tray edges during the heating and cooling phases. The RF welding process may be used on a variety of materials including PVC and polyurethanes, nylon, PET, Ethyl Vinyl Acetate and some Acrylonitrile Butadiene Styrene resins.

In another embodiment, bonding is achieved using ultrasonic vibratory energy welding. In this approach, the mating surfaces at the lid and tray edges of the food container system are melted by the vibrating ultrasonic tool. When the tool is removed, the material solidifies and a weld is achieved. The resultant bond is therefore irreversibly bonded with a strength that approaches that of the parent material. The advantage of ultrasonic and RF welding over other bonding methods described here are that they utilize no consumables in their processes.

Further areas of applicability of the present invention will become apparent from the detailed description provided hereinafter. It should be understood that the detailed description and specific examples are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1A:
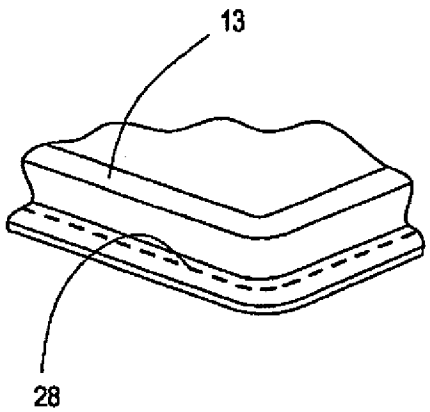
FIG. 1A is an enlarged view of the corner of the lid of the container system in FIG. 1.

The following descriptions of the preferred embodiments are merely exemplary in nature and is in no way intended to limit the invention, its application, or uses. Turning now in detail to FIGS. 1, 3, 4 and 5, therein illustrated is a single rigid polymer plastic construct food container system 10 that includes a lid 12 and a tray 14 that are flexibly connected together at a hinge 16 at which the lid 12 may rotate relative to the tray 14. When shut, the container system will enclose food contents placed in the tray. 14. Sealing of the contents would be achieved by bonding the lid 12 to the tray 14 at outer periphery faying surfaces 20, 22 between points 21 to 23 and 17 to 19 respectively to form a bonded regions 33, 33'. Such bonding may achieved by a variety of methods including, but not necessarily limited to, radiation light-based curing, ultrasonic welding or radio frequency welding.

Figure 1:
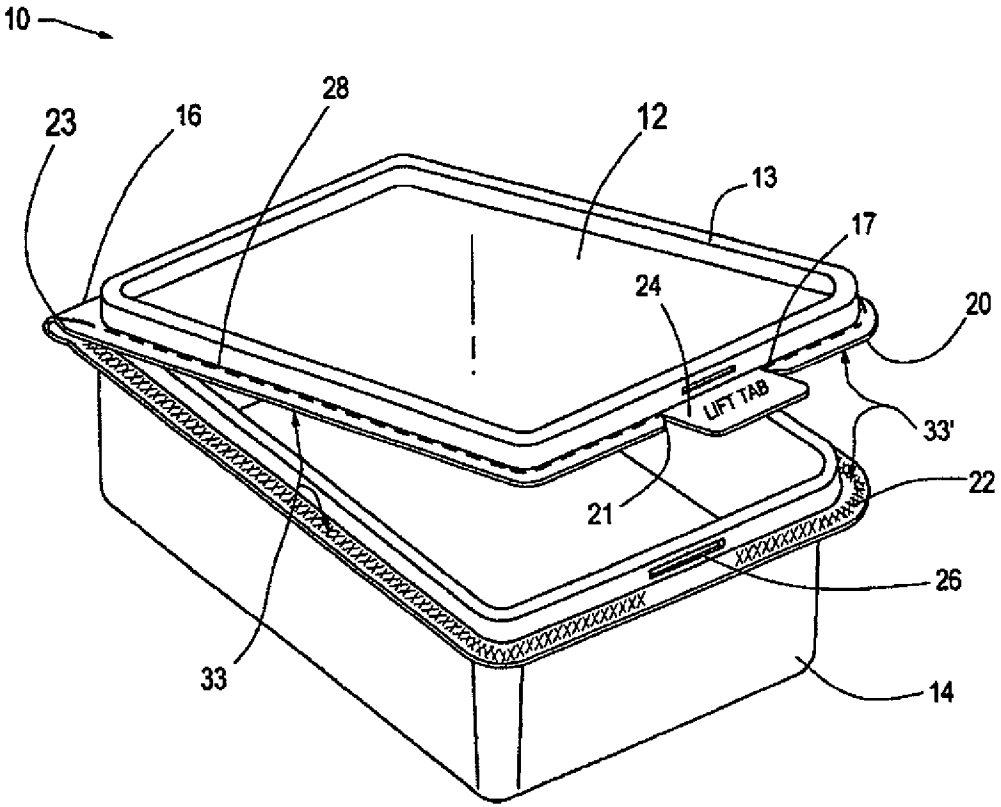
FIG. 1 is an isometric view of the container system that shows one embodiment of the invention.
Figure 2:
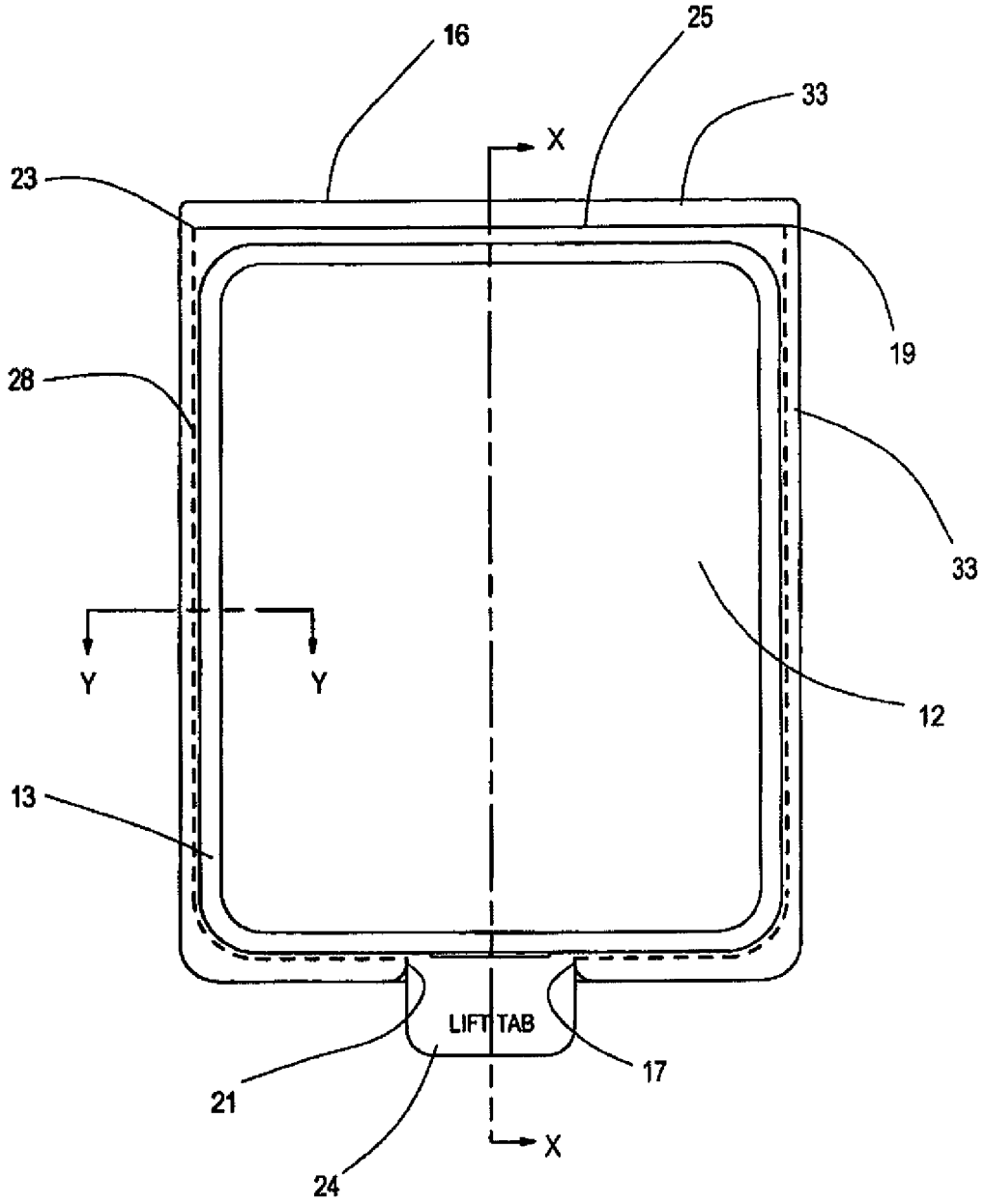
FIG. 2 is a plan view of another embodiment of the invention.
Figure 3:
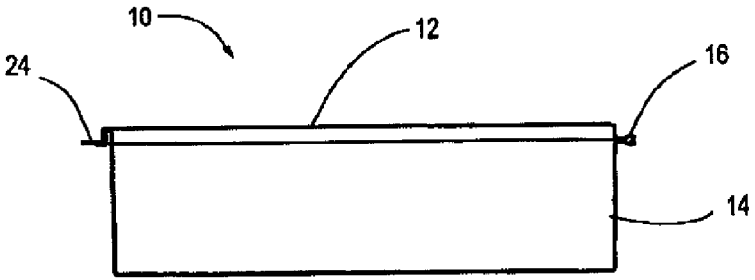
FIG. 3 is a side view of the cross-section taken substantially along the line X-X of the container system in FIG. 2.
Figure 5:
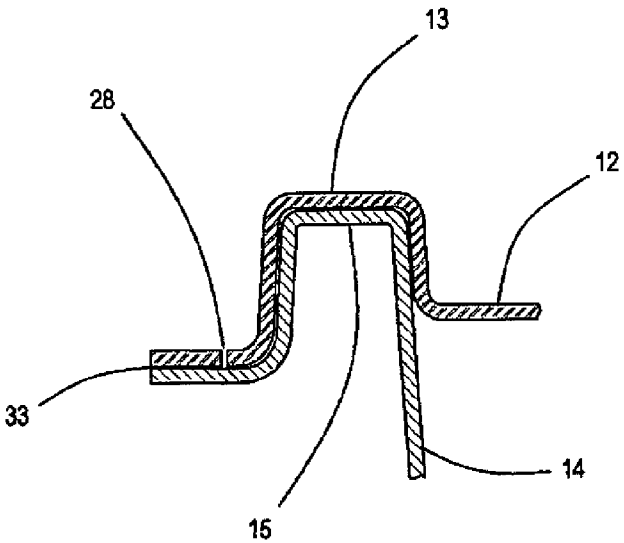
FIG. 5 is an enlarged side view of the cross-section taken substantially along the line Y-Y of the container system in FIG. 2.
Figure 4:
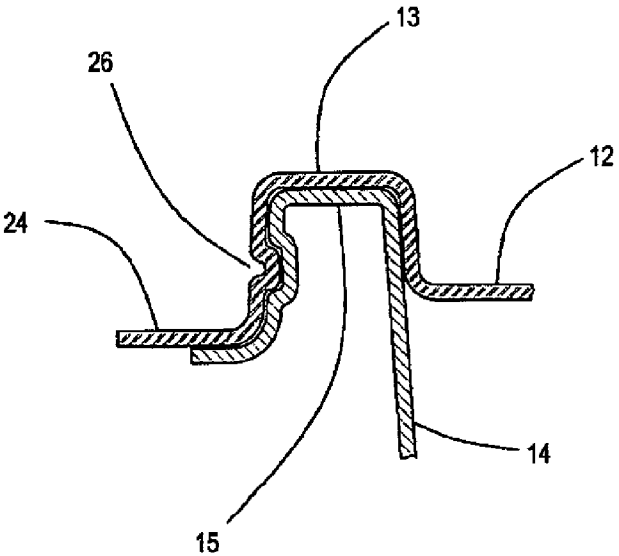
FIG. 4 is an enlarged view of the lift tab and releaseably lockable snap-fit grip of the container system in FIG. 3.
Figure 9:
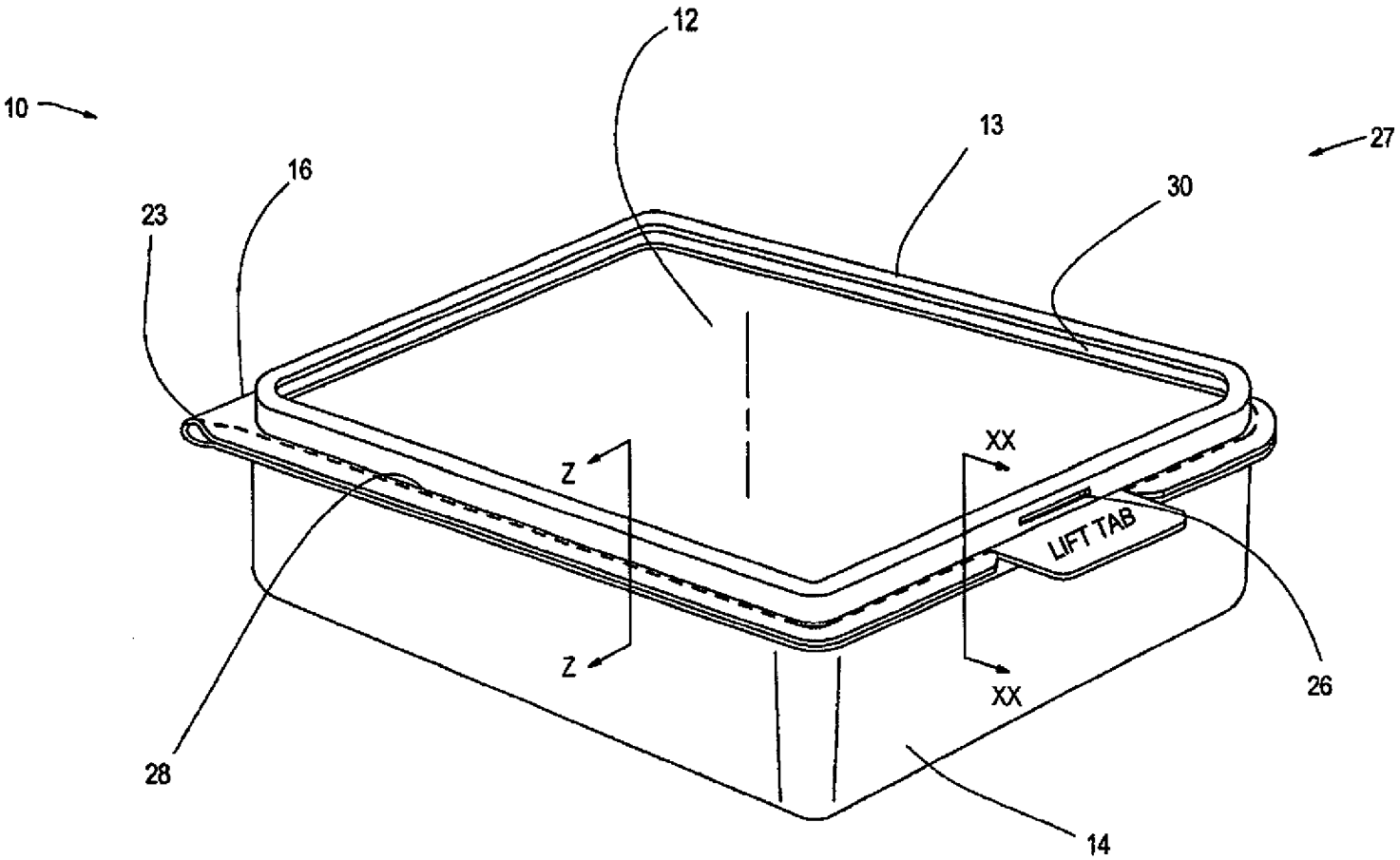
FIG. 9 illustrates is the container system of FIG. 8 but with the mating surfaces of the lid and tray engaged.
Figure 10:
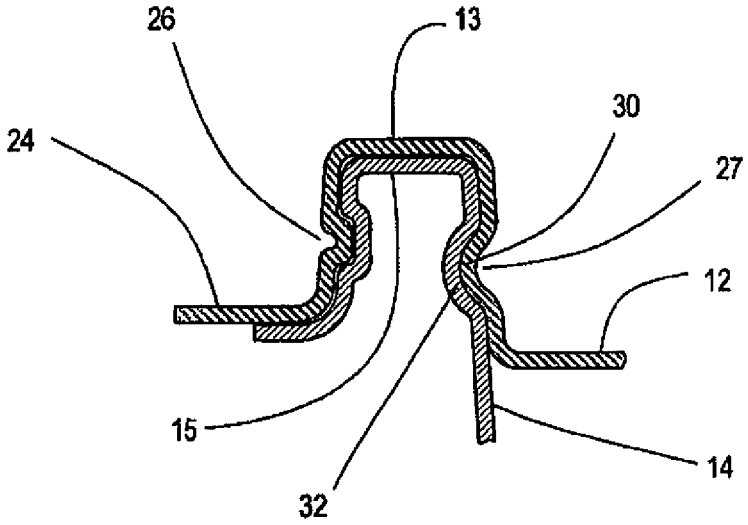
FIG. 10 is an enlarged view of the cross-section taken in substantially along the line XX-XX of the container system in FIG. 9.
Figure 11:
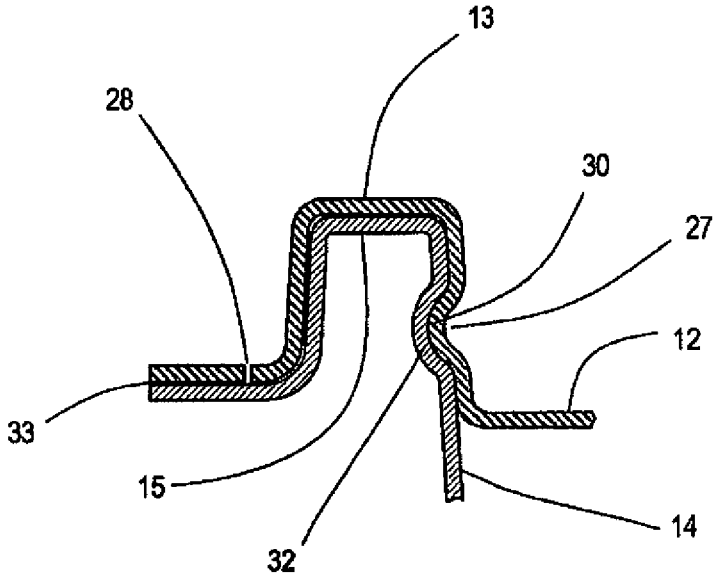
FIG. 11 is an enlarged view of the cross-section taken in substantially along the line Z-Z of the container system in FIG. 9.

As illustrated in FIGS. 4 and 5, as well as in FIGS. 10 and 11, the lid 12 is further defined by an inner periphery that is a raised channel 13 into which a complementary raised edge 15 of the tray fits into thereby forming a dovetail interlocking joint and releaseably fastening the lid 12 and the tray 14. Fastening of the lid 12 to the tray 14 is achieved by virtue of a squeeze fit between the raised channel 13 of the lid 12 and the complementary mating raised edge 15 of the tray 14. The lid 12 is further held in place by a reversibly lockable discrete snap-fit grip 26 that is adjacent to a lift tab 24 that is a contiguous element of the lid edge 20 except that it is marginally extended to facilitate easy grasping by thumb and fingers. The reversibly lockable discrete snap-fit grip 26 and lift tab 24 is generally placed at a distal end from the hinge 16 to provide leverage in raising and pivoting the lid 12 around the axis of the hinge 16. As depicted in FIGS. 1, 1A, 2, 6, 7, 8, 9, 12, 13 and 14, the lid 12 includes perforations 28 that are located at an intermediate periphery of the lid 12 from the inner periphery of the lid 12 as defined by squeeze fit raised edge and groove 13, 15 of the lid 12 and tray 12 respectively. As depicted in FIGS. 1 and 2, the line of perforations 28 are discontinuous beginning at point 17, 21 of the lift tab 24 and extending only along the intermediate periphery of the lid 12 terminating at points 19, 23 distal from the location of the lift tab 24. It is intended that ingress of the container will be achieved through raising of the lid by lifting the lift tab 24 and tearing along the perforations 28 and rotating the lid 12 around the axis of the hinge 16. Turning to FIG. 2, therein is illustrated an embodiment that after tearing at the perforations 28 to release the lid 12, the detached portion of the lid 12 can pivot along an edge defined by the fold line 25 approximately connecting the points 19 and 23. In the one embodiments illustrated in FIGS. 1, 6, 7, 8 and 11, the fold line 25 is the hinge 16. It is an intent of this invention that once the broken interconnect between the perforations 28 is torn, it would not be possible for the broken interconnect to be reconnected again; additionally, and as importantly, such tearing, however, minimal will be visible to the naked eye or touch. It is anticipated that the consumer will be provided added assurance that the food product purchased is unlikely to have been tampered with.

Figure 12:
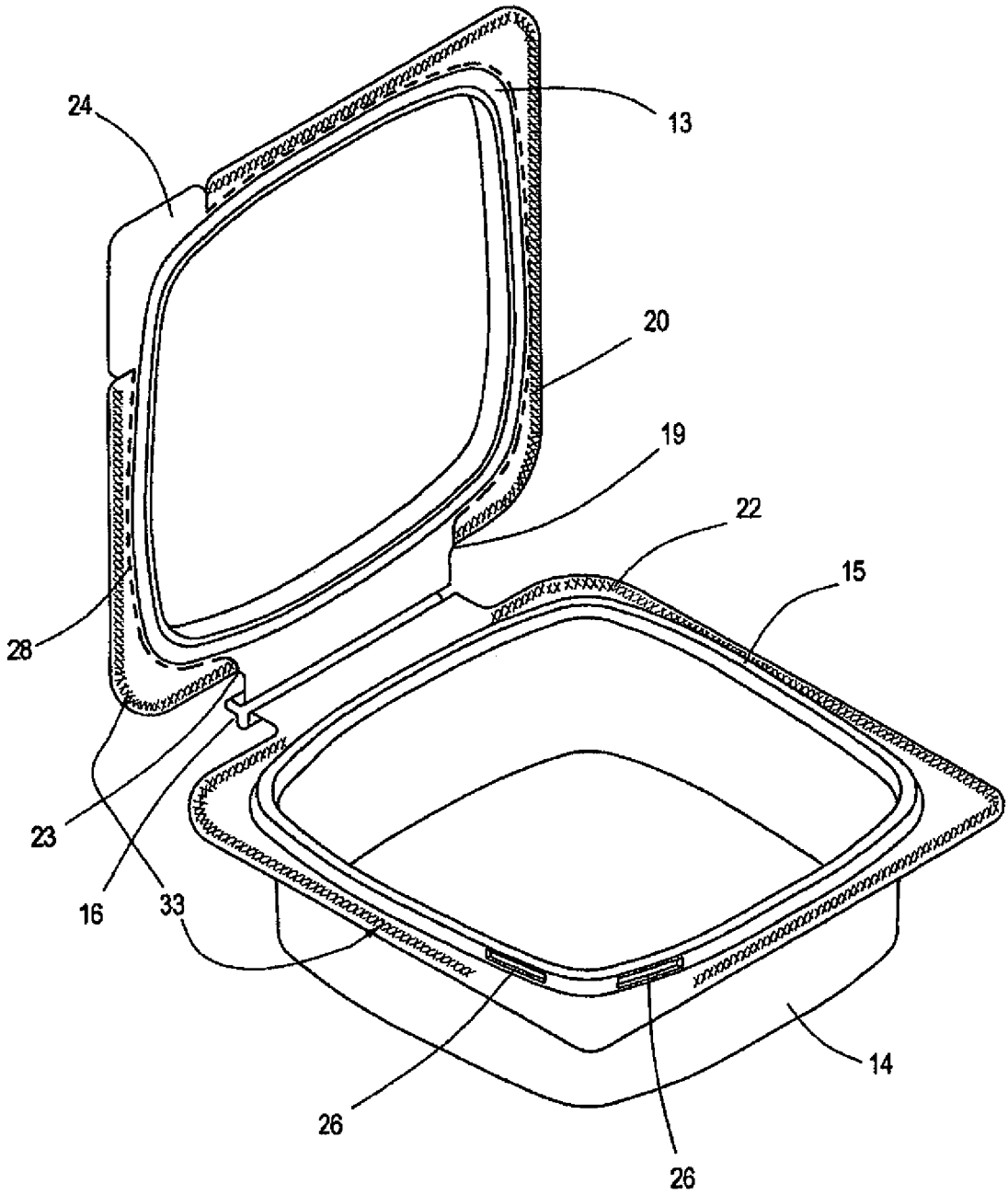
FIG. 12 is a perspective view of another embodiment of the invention.
Figure 13:
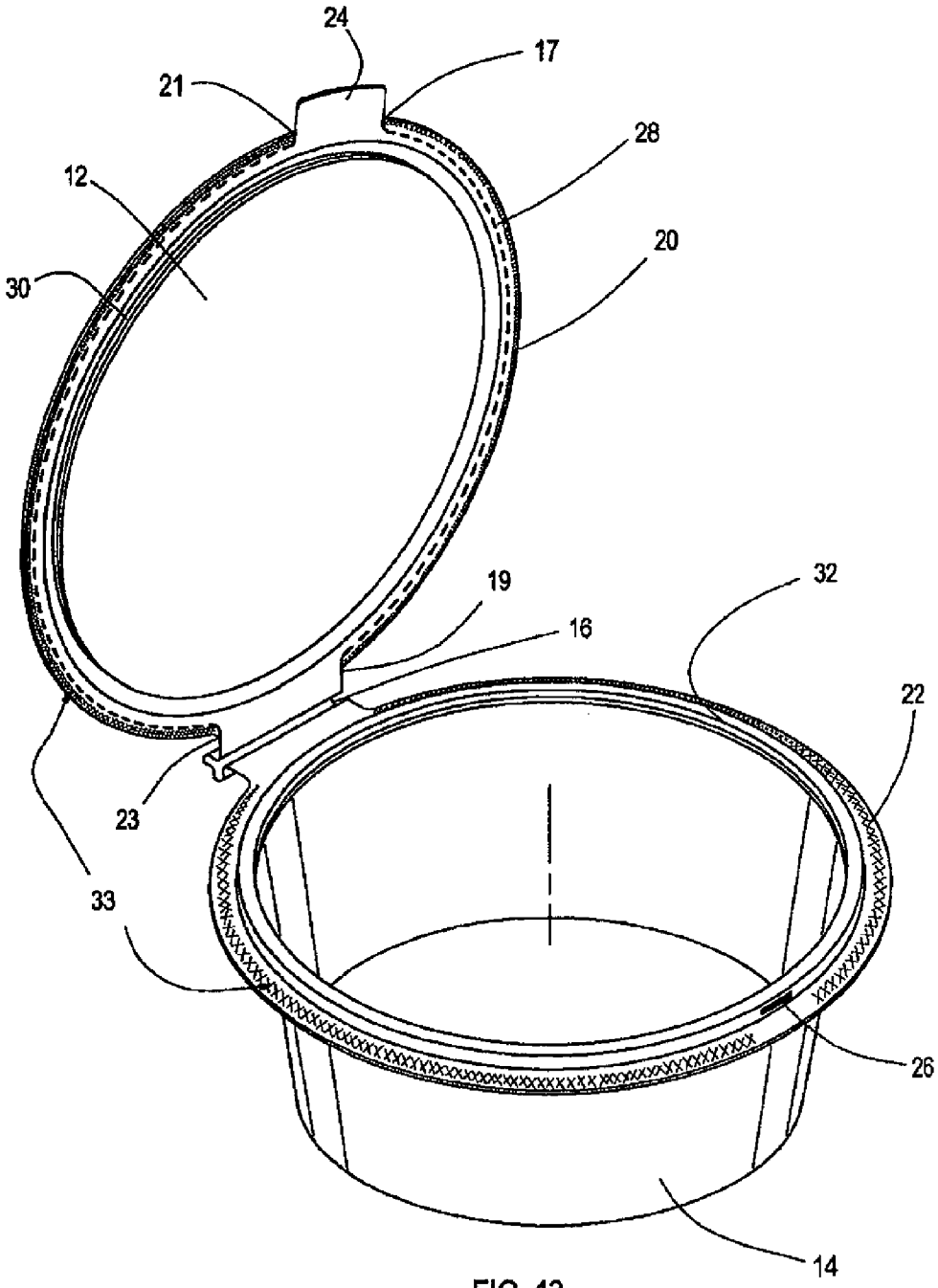
FIG. 13 is a perspective view of another embodiment of the invention
Figure 14:
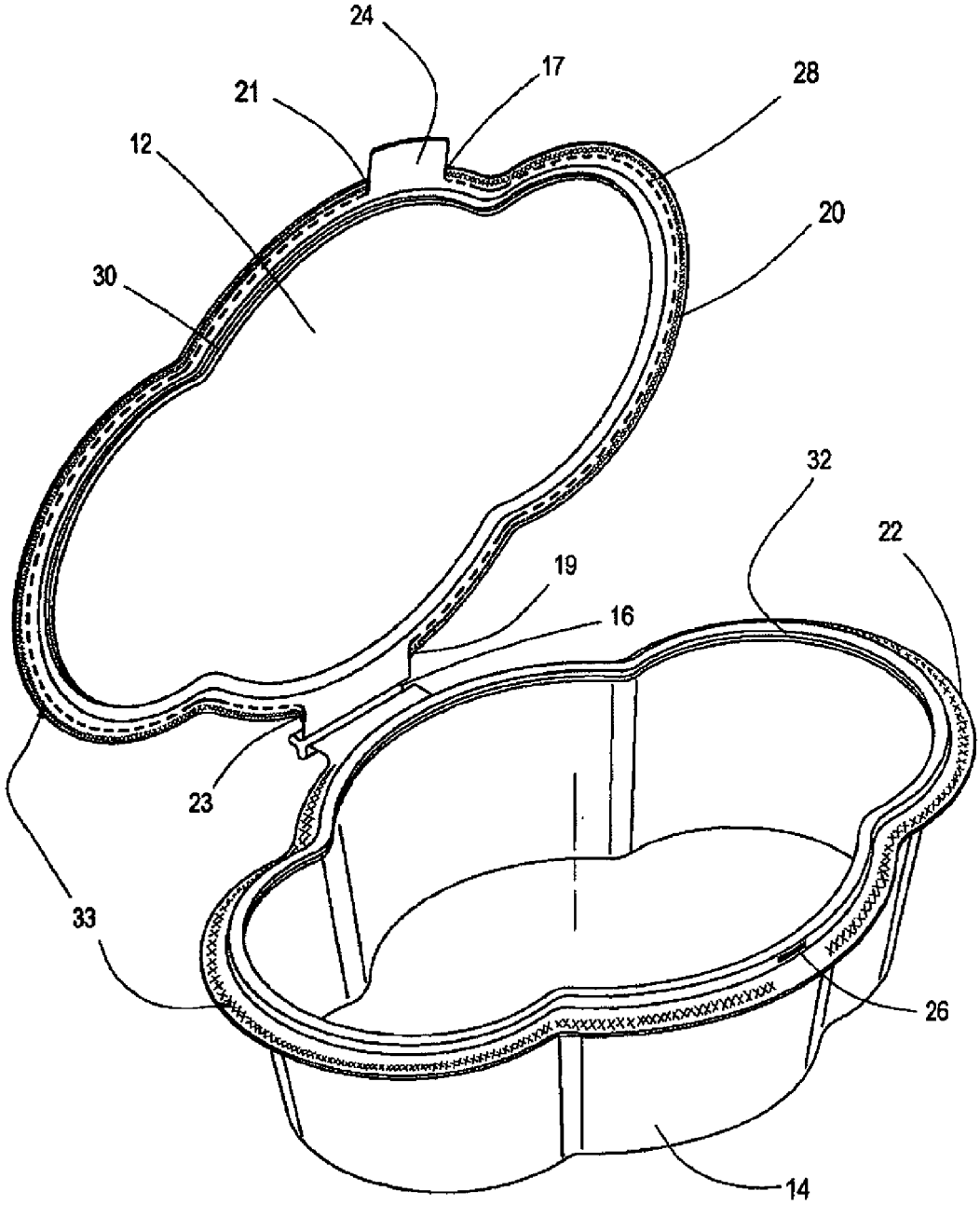
FIG. 14 is a perspective view of another embodiment of the invention.

FIG. 1 illustrates a food container systems constructed from a single piece of rigid plastic, however, other embodiments of the invention may include a lid 12 and a tray 14 that are of a two-piece construction. Additionally, FIGS. 1, 2, 6, 7 and 8 illustrate a food container system of the present invention wherein the shape of the food container is rectangular when viewed from above. This is merely exemplary and not a limitation of the present invention. As illustrated by FIGS. 12, 13 and 14, the food container system may take the form of a large variety of shapes.

Figure 6:
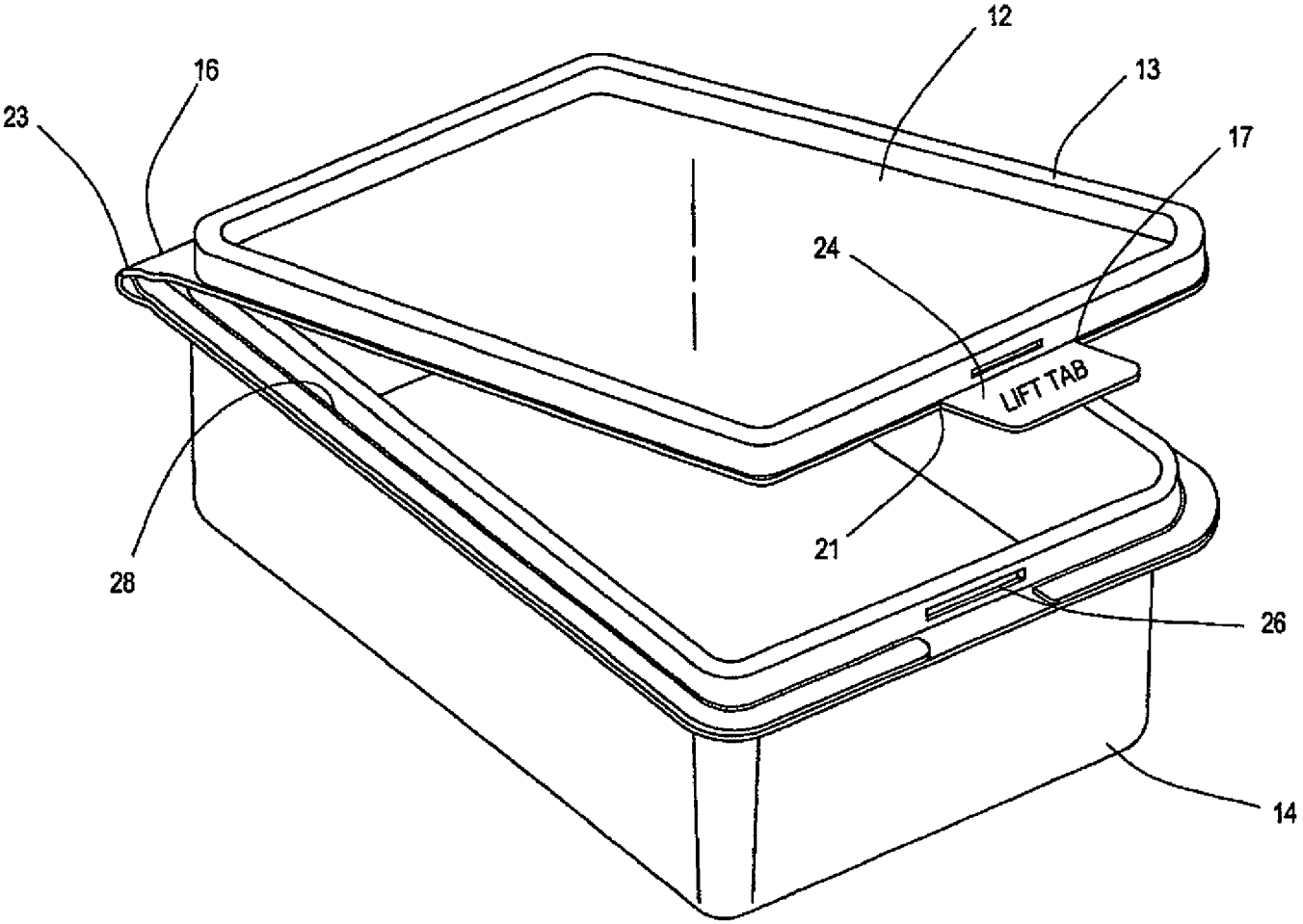
FIG. 6 is an isometric view of the container system of FIG. 1 but showing the lid torn at the rows of perforations in order to open 5 the food container.
Figure 7:
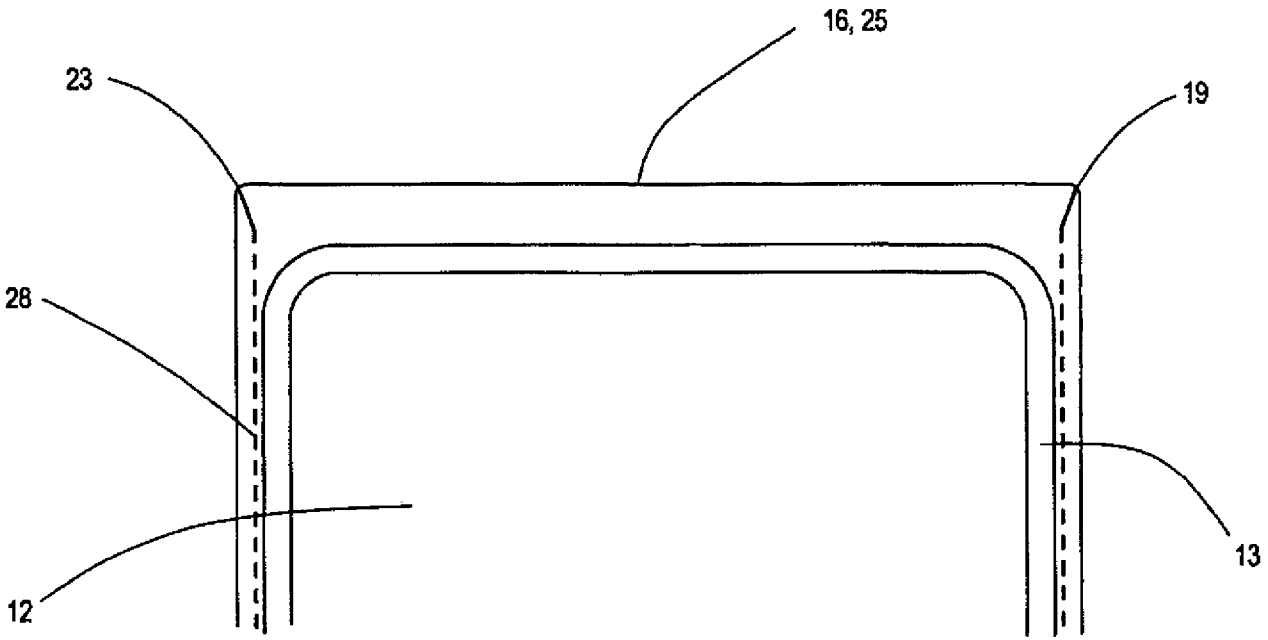
FIG. 7 is a plan view of the hinge portion of an embodiment of the invention similar to that in FIG. 2 but with the row of perforations in the lid extending to the edge of the lid and the absence of any bonding at the hinge side of the container.

In the embodiment illustrated in FIG. 1, the location of the lift tab 24 and corresponding discrete snap-fit grip 26 are positioned directly across from the hinge 16 of the food container system 10 to facilitate lifting and tearing of the lid 12. Location of the lift tab 24 and corresponding discrete snap-fit grip 26 need only be at a convenient distal location from the hinge. The embodiment in FIG. 12 shows the lift tab 24 and discrete snap-fit grips 26 positioned at the corner of the lid 12. FIG. 6 illustrates the food container system of FIG. 1 but with the lid 12 torn along the perforations 28 and pivoted around the hinge 16.

The figures illustrate packaging concepts made from plastic, which is made up principally of a binder together with plasticizers, fillers, pigments, and other additives. There is significant literature on the chemistry and manufacturing processes, as well as applications related to plastics. For the purposes of this invention, plastic trays and matching lids have been available in a variety of designs and has found applications in numerous markets from food and general purpose industrial product to retail products because of its versatility in material characteristics allowing the plastic designer to affect its strength, imperviousness, flexibility, robustness, mold-ability and clarity, among other things.

Figure 8:
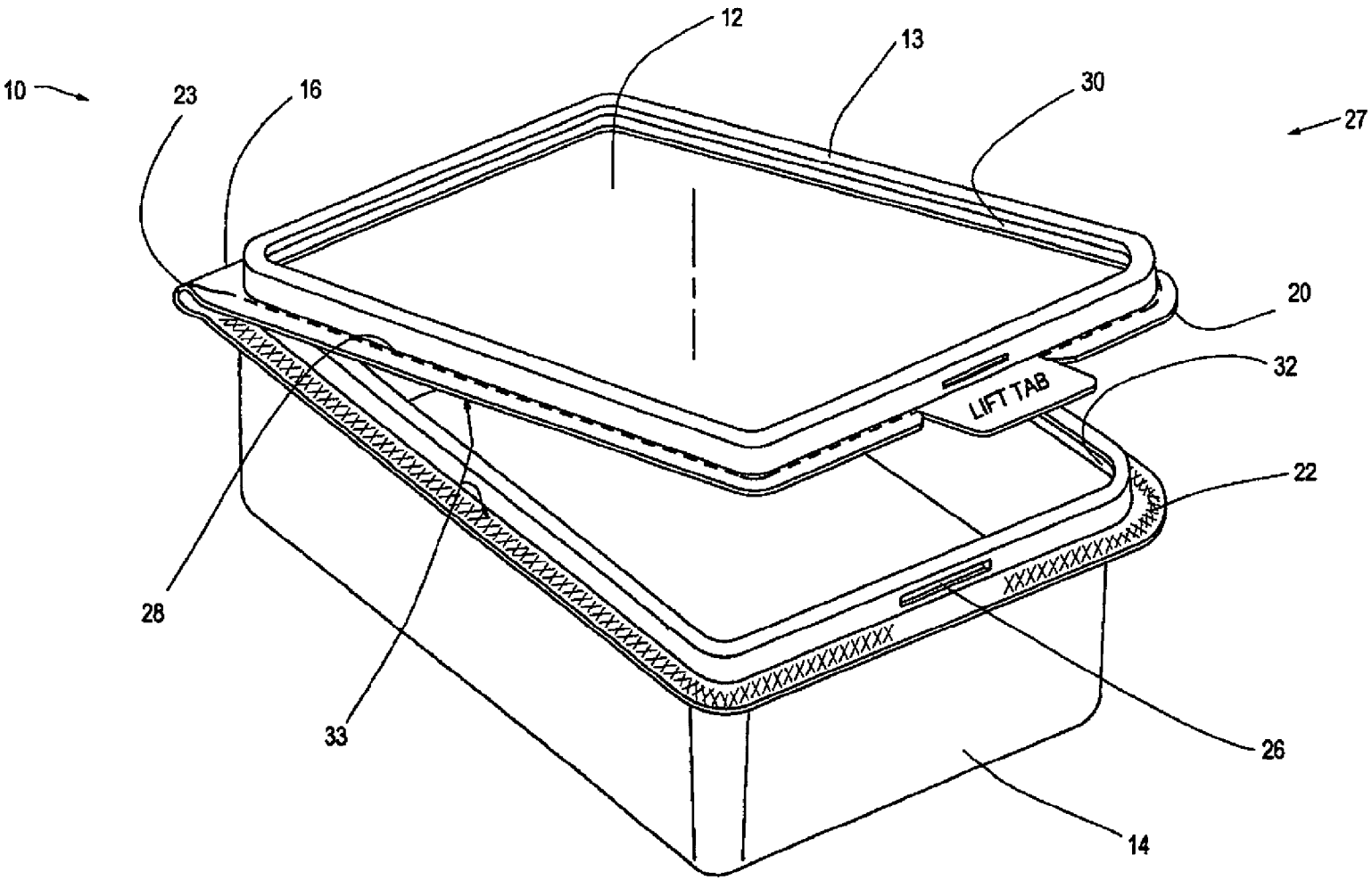
FIG. 8 is an isometric view of an embodiment of the invention showing the hinge portion illustrated in FIG. 7 and the annular releaseably lockable snap-fit mechanisms of the container system.

FIGS. 8, 9 and 10 show embodiments of invention that include a continuous snap-fit grip 27 along a periphery of the lid 12 and tray 14. In this embodiment shown, the lid 12 has a continuous raised rib 30 that opposes a matching groove 32 located in the sidewall of the tray 14. By depressing the lid 12 into the tray 14 and engaging the raised rib 30 into the matching groove 32, the snap-fit grip effectively provides a leak-proof seal that allows the consumer to open, close and releaseably lock the container system 10 multiple times. Some of the advantages of this aspect of the invention are that food freshness can be extended then would otherwise occur without sealing and spillage of the food content is prevented.

Bonding of the lid to the tray to the lid may be achieved by a variety of methods, including radiation light sensitive curing such as with ultraviolet (UV) and infrared (IR) light and/or either ultrasonic welding and radio frequency (RF) welding. For radiation light curing, the adhesive can be disposed at any suitable time during the manufacturing process. The adhesive is disposed on one or both of the faying surfaces 20, 22 of the lid 12 and tray 14, and except for the lift tab region, it can be disposed over part or all of the area of the bonding region 33. In the embodiment illustrated in FIG. 2, bonding of the lid 12 and tray 14 includes the entire length of the hinge 16 whereas in the embodiment illustrated in FIG. 1 and other illustrations, the bonding does not extend the length of the hinge 16 but ends at points 19, 23 as previously described.

Snap-fit grips as referred to in the above embodiments are a well-known, common assembly method for rigid polymer molded parts, and are not the subject of the invention. A snap-fit is a mechanical joint system where part-to-part attachment is accomplished with locking features (constraint features) that are homogenous with one or the other of the components being joined. Joining requires the flexible, locking features 30, 32 to move aside for engagement with its the mating part, followed by return of the locking features 30, 32 toward their original positions to accomplish the interference fit required to latch the lid 12 and tray 14 together. The illustrations contained in the FIGS. 8, 9 and 10 show that the snap-fits are molded into the lid 12 and the tray 14. Since the material of construction of the food container is a rigid polymer, the lid 12 and tray 14 can be assembled, disassembled and reassembled many times over without a decline in reliability. However; in order to enable a quality snap-fit, a high degree of precision is needed to ensure that the force-fitting of the male rib 30 to female groove 32 of the snap-fit is true. The combination of bonding at the faying surfaces 20, 22 and snap-fit grips 27 serve to prevent contaminants such as moisture, debris, and other substances from entering the food container system. For the embodiments described, the snap-fit grip joint is meant to be easily detachable as opposed to being made to be inseparable.

Figure 15:
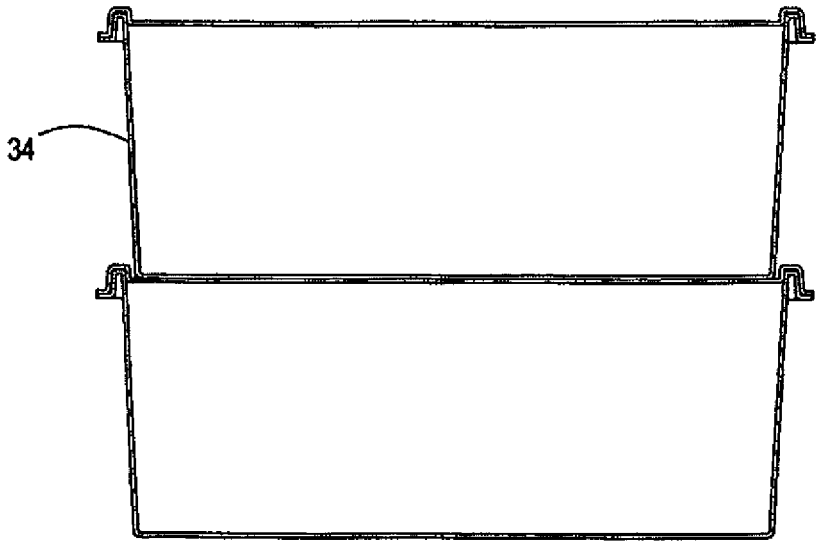
FIG. 15 is side cross-section view of the container system illustrating how the food containers may be stacked.

Turning finally to FIG. 15, the sidewall 34 of the tray 14 of the food container system can be either tapered or formed in such a way as to fit snugly into a shallow recess of the lid 12. In this way food processors are able to stack the food containers and maximize the use of valuable, limited space for both storage and transportation purposes. The same benefit is afforded the retailer whose need to advertise by affixing labels of the product content to the side wall and/or top of the food container for viewing by the prospective consumer remain unaffected.

Although particular embodiments of the invention has been described in detail for purposes of illustration, various modifications and enhancements may be made without departing from the spirit and scope of the invention. Accordingly, the invention is not to be limited except as by the appended claims.

The invention claimed is:

1. A container comprising:

a lid having:

a horizontally-extending lid flange along at least one edge, a first line of weakness in the lid flange adjacent a permanent bond, a second line of weakness in the lid flange, and a lift tab disposed proximate an end of each of the first line of weakness and the second line of weakness and opposite a hinge;

a tray having a horizontally-extending tray flange along the at least one edge;

the hinge coupling the lid to the tray, the lid flange aligned with the tray flange when in a closed position;

an interlocking joint formed by a raised interlocking portion of the lid extending upwardly directly from the lid flange and a complementary interlocking portion of the tray extending upwardly directly from the tray flange; and the permanent bond joining the lid flange to the tray flange along at least one region.

2. The container of claim 1, wherein the lid and the tray are a one-piece construction.

3. The container of claim 1, wherein the lid and the tray are joined along the region by a radiation light-based adhesive bond.

4. The container of claim 3, wherein the radiation light-based adhesive bond includes an adhesive material cured by ultra-violet light.

5. The container of claim 3, wherein the radiation light-based curing bond includes an adhesive material cured by infrared light.

6. The container of claim 1, wherein the lid and the tray are joined along the region by an ultrasonic weld.

7. The container of claim 1, wherein the lid and the tray are joined along the region by a radio frequency weld.

8. The container of claim 1, wherein the material of the lid and the tray is polystyrene, polypropylene, polyethylene terephthalate, polyactide, polyvinyl chloride, or other rigid polymers.

9. The container of claim 1, wherein the container is stackable.

10. The container of claim 1, wherein the lid is constructed using a process taking from a group consisting of thermoforming, injection molding, transfer molding, and blow molding.

11. The container of claim 1, wherein the tray is constructed using a process taking from a group consisting of thermoforming, injection molding, transfer molding, and blow molding.

12. The container of claim 1, wherein the interlocking joint is on the opposite side of the line of weakness from the permanent bond.

13. The container of claim 1, wherein the interlocking portion of the lid is a raised channel.

14. The container of claim 13, wherein the raised channel has a base that lies in a plane different from the lid flange.

15. The container of claim 1, wherein the lid flange is planar.

16. The container of claim 1, wherein the lid flange extends horizontally outward from the container.

17. The container of claim 1, wherein the lid flange lies below a top of the raised interlocking portion of the lid.

18. The container of claim 1, wherein the raised interlocking portion of the lid is raised in a first direction, and the lid flange extends in a second direction perpendicular to the first direction.

19. The container of claim 1, wherein the tray flange is free of score lines.

* * * * *